United States Patent [19]

Nelles et al.

[11] Patent Number: 4,471,544

[45] Date of Patent: Sep. 18, 1984

[54] THREE DIMENSIONAL IMFORMATION TRANSMITTING DEVICE

[76] Inventors: Thomas R. Nelles, 1804 N. Beech Rd.; Jeffery H. Bernahl, 1108 Juniper La., both of Mount Prospect, Ill. 60056; Harold L. Spitzer, 4 Sweetwood Ct., Indian Heak Park, Ill. 60525

[21] Appl. No.: 415,062

[22] Filed: Sep. 7, 1982

[51] Int. Cl.[3] ..... G09F 3/18

[52] U.S. Cl. ..... 40/16

[58] Field of Search ..... 40/16, 16.2, 16.4, 16.6, 40/613, 124.1, 539, 617, 155, 610; 46/1 L; 24/67 PR, 67.5, 67 P, 350

[56] References Cited

U.S. PATENT DOCUMENTS

| | | | |
|---|---|---|---|
| 1,566,735 | 12/1925 | Chesney | 40/539 |
| 1,803,325 | 5/1931 | Freedman et al. | 40/539 |
| 2,032,561 | 3/1936 | Buehler | 40/617 |
| 2,984,031 | 5/1961 | Giesecke | 40/124.1 |
| 3,120,685 | 2/1964 | Shears | 24/67 PR |
| 3,711,977 | 1/1973 | Blankenhorn | 40/124.1 |
| 3,753,305 | 8/1973 | Mueh | 40/124.1 |
| 3,977,109 | 8/1976 | Berry, Jr. et al. | 40/124.1 |
| 4,222,187 | 9/1980 | Huck | 40/539 |
| 4,239,825 | 12/1980 | Kaulfuss et al. | 40/539 |

*Primary Examiner*—John J. Wilson

[57] ABSTRACT

A single sheet, of paper for example, is cut and provided with fold lines, such that when folded printing on a single side thereof becomes visible in two different directions. The device included a support carries wing-like portions which when folded and locked, project generally horizontally into the space in front of the support.

2 Claims, 10 Drawing Figures

THREE DIMENSIONAL IMFORMATION TRANSMITTING DEVICE

BACKGROUND OF THE INVENTION

This invention relates to an information transmitting device and more particularly to a device which provides a three dimensional viewing surface from two different directions, and yet only employs one side printing.

DESCRIPTION OF THE PRIOR ART

Information transmitting devices, for example, marketing devices, have and are subject of intense study and investigation. The number of such devices designed is probably very, very great. The objective, however, of a vast majority is the same - engage the mind of the prospective customer, cause them to think as to the message, and to create in their mind a need.

SUMMARY OF THE INVENTION

Therefore, it is an object of the present invention to provide a display device which can, from a distance, engage the eye of the potential customer as they move down the supermarket aisle.

Yet another object of this invention is to provide a three dimensional advertising device which maximizes the visual angle of recognition between the message to be transmitted and the customer.

But another object of this invention is to provide a flat unitary resilient sheet having a message on only one side which can be folded into a three dimensional advertising device.

Still another object of this invention is to provide a device which can be cut in any shape desired, to create a novel effect and which displays an advertising message spacially removed from the merchandise.

Another object of this invention to provide a three dimensional information transmitting device which is bent in a predetermined manner to create both a three dimensional effect, and to provide support.

A further object of this invention is to provide an attention getting device which is secured in a pricing rail and resiliently suspended in a spaced relationship before the commodity shelf.

But another object of this invention is to provide an information bearing device which will maintain a predetermined position generally perpendicular to the passerby's direction to travel, and parallel to their field of vision.

Still another object of this invention is to provide an advertising display device which contains further information concerning the offered goods in the form of tear-off sheets on pads.

To this end, the invention provides a device constructed of a single flat sheet of, for example paper, for the transmission of information. The sheet is cut and scored to create a bridge portion from which depends first and second body portions in an angled winglike manner. A holding or locking means, also carried by the bridge portion, secures the two body portions against each other such that because of their angled relationship they are caused to warp or bend, thus resulting in strengthening and creating depth. A support tab is flexibly connected to the backside of the bridge portion and thus the device is capable of mounting in the channel of a stocking shelf. This flex tab serves as a hinge whereby the bridge portion, carrying the two body portions, projects horizontally into the space in front of the commodity shelf such that it can be struck from below it will bend upwardly without being damaged or destroyed. Further the major plane of the bridge portion is generally perpendicular to the major plane of the support tab, while the major plane generally of the body portions is perpendicular to that of the bridge portion. The result being in practice that, as stated, the bridge portion and the two body portions, each of which a message may occupy, are in a spacial attention-getting relationship to the commodity shelf where the product may be located and to the potential customer who is moving by.

DESCRIPTION OF THE DRAWINGS

A preferred embodiment, and one variation thereof, which are intended to be illustrative of and not a limitation on the invention will now be described with reference to the drawings in which.

Figure 1:
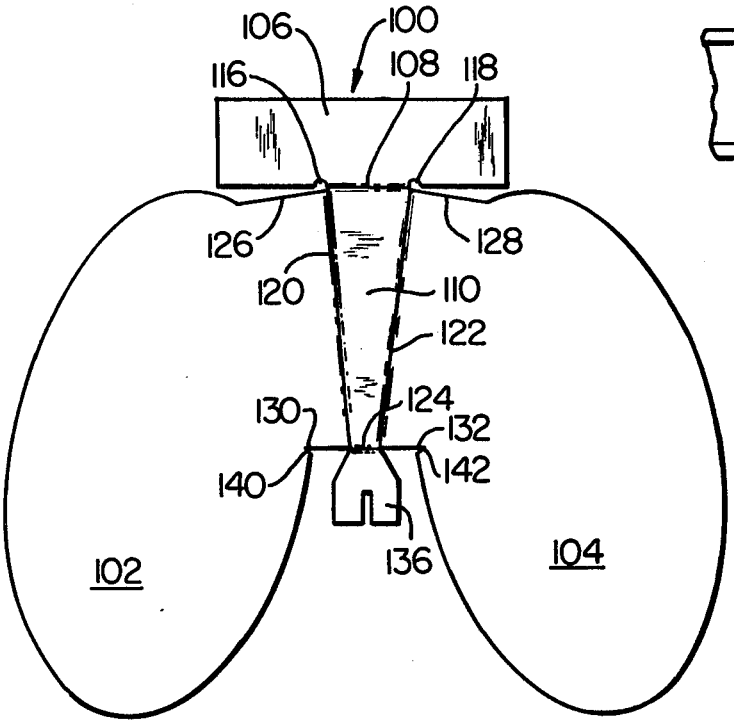
FIG. 1 is a plan view of the preferred embodiment as a flat sheet prior to folding and bending.
Figure 3:
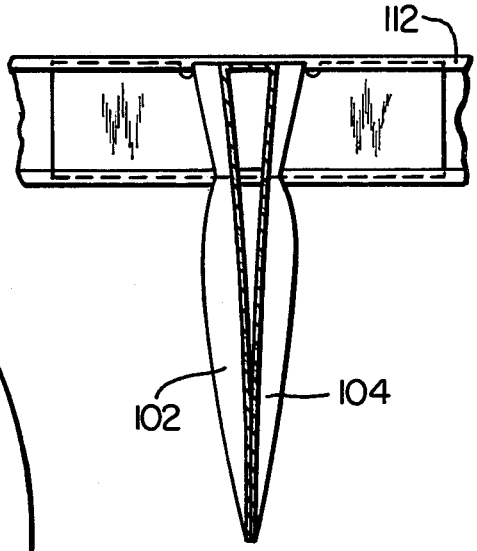
FIG. 3 is a front view of the preferred embodiment of FIG. 2 taken along the line 3—3 of FIG. 2.
Figure 4:
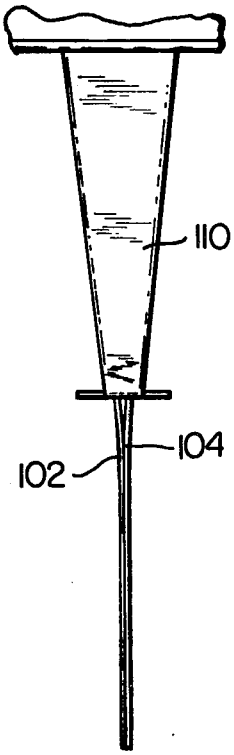
FIG. 4 is a top plan view of the preferred embodiment of FIG. 1 folded as shown in FIG. 2.

Referring now to the preferred embodiment as shown in FIGS. 1–5 and specifically in FIG. 1. The three dimensional information display means 100 is preferably constructed of heavy paper or other similar inexpensive material. The display means 100 as shown in FIG. 1 is in a flat unfolded position, thus facilitating inexpensive and simple shipment as well as economical manufacture and importantly allows one side printing. Once the display means 100 is folded as shown in FIGS. 2–5, it assumes a three dimensional configuration. As is apparent, the message, price, pictures, graphic display, etc. which are printed on the first and second body portion means or wing-like means 102 and 104 are then visible to a prospective customer who may approach it either from the left or right of it as shown in FIG. 3.

Figure 2:
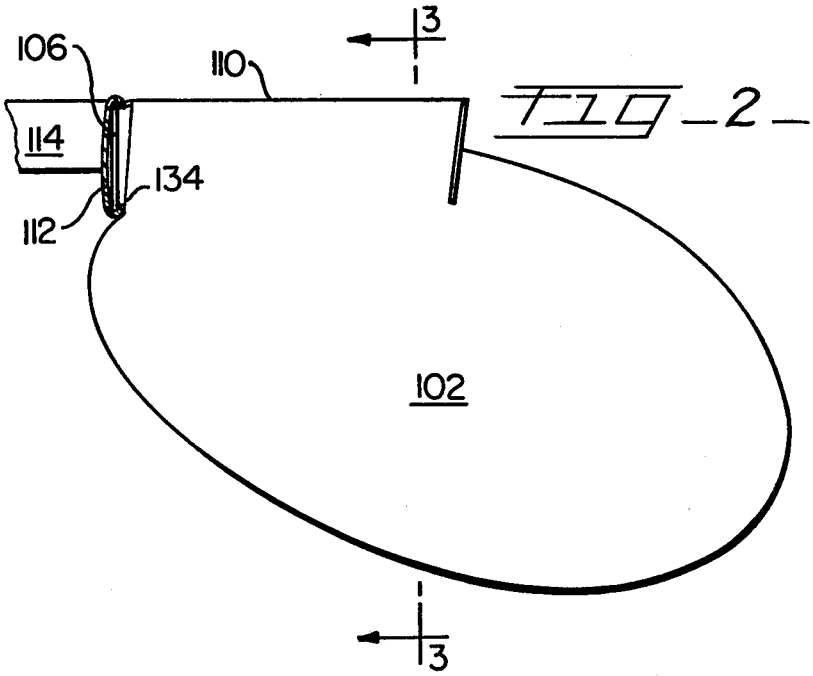
FIG. 2 is a plan side view of the preferred embodiment shown in FIG. 1 as folded into their final form.
Figure 5:
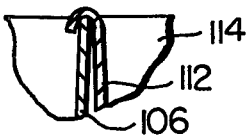
FIG. 5 is an sectional view showing the supporting tab engaged in a pricing rail.

In this embodiment, a supporting means 106 is hingidly or flexably connected along a first fold line means 108 to a bridge or bridging portion means 110. The supporting means 106 as shown in FIG. 2 is designed for cooperation with a pricing channel or rail means 112, which is in turn secured to the facing edge of a commodity shelf 114. Cut out means 116 and 118 are provided to allow insertion into the pricing channel 112 by bowing the support means 106 slightly and inserting it.

It is apparent thus, that the display means 100 offers a high degree of mobility in that it can be set up or taken down without the use of tools, tape, staples, string, etc.

The bridge means 110 includes second and third and fourth fold line means 120, 122 and 124. Connected via fold line means 120 and 122 are the wing-like means 102 and 104 in a hinge-like fashion. As shown in FIGS. 2 and 3, in use the wing-like means 102 and 104 are bent downwardly such that their individual major planes, which in FIG. 2 are parallel to the plane of the sheet, are generally perpendicular to the major plane of the bridging means 110. Which as shown in FIG. 2 extends up perpendicular from the plane of the sheet and from left to right. Supporting means 106 also has a major plane, which as shown in FIG. 2, extends into and out of the sheet, and is generally perpendicular to that of the major plane of bridging means 110.

The wing-like means 102 and 104 can be of any general shape depending on the message etc. to be conveyed. In this embodiment they each include: a free end; an orientating means 126 and 128 arranged at the other end and cut-out means 130 and 132 arranged at approximatley the midsection thereof. The orientating means 126 and 128 or at least one of them, are designed to abut the pricing channel means 112 as shown in FIG. 2. As is apparent, the shape of the orientating means 126 and 128 will determine whether the bridge means will extend straight out from the commodity shelf, as in FIG. 2 or angle up or down. Remove material from the area 134 of orientating means 126 and 28 and it will angle down, add material and it will angle up. This may be desirable to create additional effect.

The cut-out portions 130 and 132 are designed to cooperate with a locking or holding means 136, as shown in FIG. 1 in order to secure the wing-like means 102 and 104 such that when folded as in FIG. 3, they are curved or bent into a particular relationship as will hereinafter discussed. The locking means 136 which secures the wing means in this manner is connected to the bridge means 110 on the fold line 124, the slot means 138 thereof allowing the insertion of the portions 140 and 142 of the wing means 102 and 104.

The locking or holding means 136, when engaging the first and second body portion or wing means 102 and 104, by virture of the fact they lie at an angle to each other, are forced together creating a degree of curvature along the major plane of each. That is, the wing means 102 and 104 are connected along fold lines 120 and 122 which define the wedge like profile of bridge means 110. Thus, when an attempt is made to force the wing means 102 and 104 against each other, they are to a degree, with the resulting curvature. This gives each wing means 102 and 104 a three dimensional feature, that is, it's not totally a flat sheet but a curved one, and allows each one to function as a load bearing member rather then a flexible, flat bendable sheet.

Thus, in practice the entire device or display means 100 can be resiliently suspended in space in front of the commodity shelf means 114 (see FIG. 2). The provision of fold line 108 allows it to hinge up if contacted from below, as for example hit by a product being removed from a lower shelf, the curvature in the wing portions 102 and 104 provide strength against outside forces directed from either the right or left (as in FIG. 3) and the orientating means 126 and 126 determine the angle at which it projects outwardly. The display means 100 thus for example, can project into the shopping aisle perpendicular to the shopper's direction of travel with a message generally parallel to the shopper's field of vision and slightly curved to provide depth.

Figure 6:
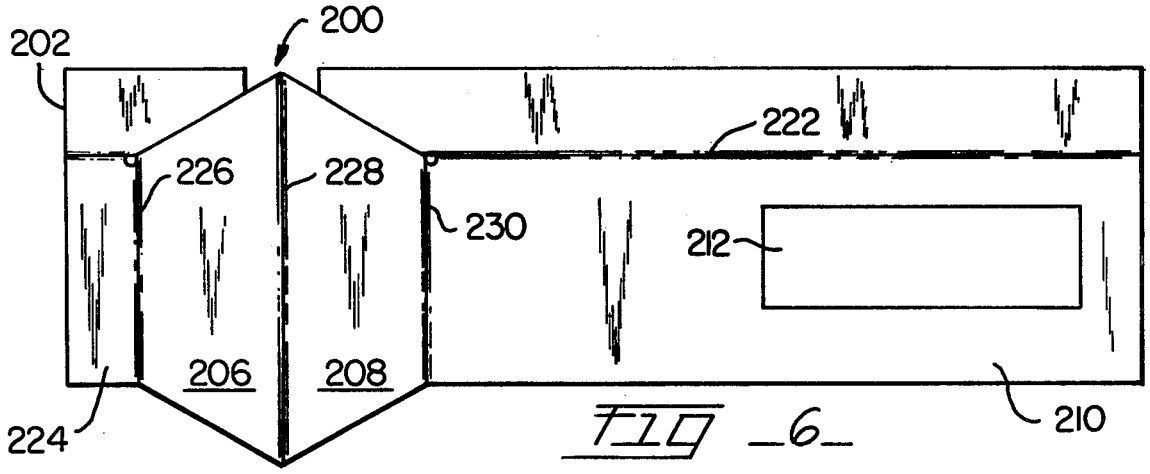
FIG. 6 is a plan view of a second embodiment illustrating the mode of folding the flat sheet.

Reference is now being made to the drawings FIGS. 6–10 wherein a second embodiment is shown and identified as display means 200. FIG. 6 shows the display means 200 as being constructed from a unitary flat resilient sheet of material, for example, paper. The display means and includes a second supporting means 202, second and third body portions or wing means 206 and 208 and a fourth body means 210 designed to provide space for the tear-off sheet means such as pad means 212.

Figure 9:
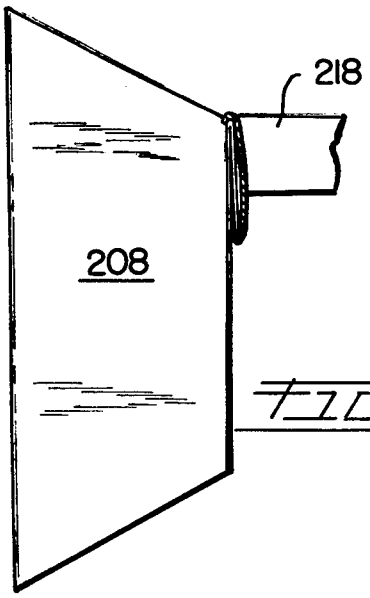
FIG. 9 is a side view of FIG. 7.
Figure 10:
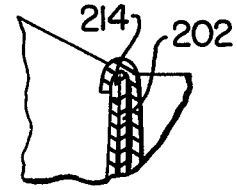
FIG. 10 is a side view of FIG. 7 taken along the lines 10—10.
Figure 10:
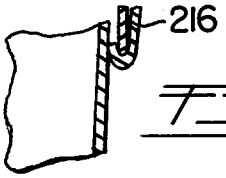

The second supporting means is flexibly connected to the body means 210 along a fold line 222. As shown in FIGS. 9 and 10, when the display device is mounted in a pricing channel 216, the support means 202 and the body portion form a double fold portion 214. The pricing channel or rail means 216 cooperates with the first supporting means 202 to secure it in a predetermined manner, with the double fold being positioned at the top flange of the pricing channel such that the display device is provided to withstand the forces generated by the removal of the tear-off sheets and the free edge of the support means being inserted in the other flange of the pricing channel. A commodity shelf means 218 or other suitable support is provided to carry the pricing rail means 216.

Horizontally projecting out into the space in front of the pricing rail 216 at an angle generally perpendicular to the shopper's direction of travel and yet parallel to their plane of vision, are the second and third body or wing means 206 and 208. As shown in FIGS. 6 and 9, they are generally trapezoidally shaped however, they may be cut in any desired shape to create novel effects and to display the advertising message spacially removed from the merchandise. This can include printed messages, prices, pictures, graphic display, advertising copy, etc. on the surfaces of wing means 206 and 208 as will as the fourth body portion 210. As stated further information concerning the advertised product can be provided through the use of tear-off sheets on pads. Such pads comprise a multitude of identical pieces of paper (cents off coupons for example) removably secured by mechanical or adhesive means.

In forming the display means 200 from a unitary flat resilient sheet, as removed from the storage or transportation container, the supporting means 202 is bent downwardly along fold line 222 (as shown in FIG. 6) to form the double material fold 214 (FIG. 10), the edge portion 224 is pushed toward the fourth body portion 210 (in the plane of the drawing sheet) causing bending along first, second, and third fold lines 226, 228, and 230.

Figure 7:
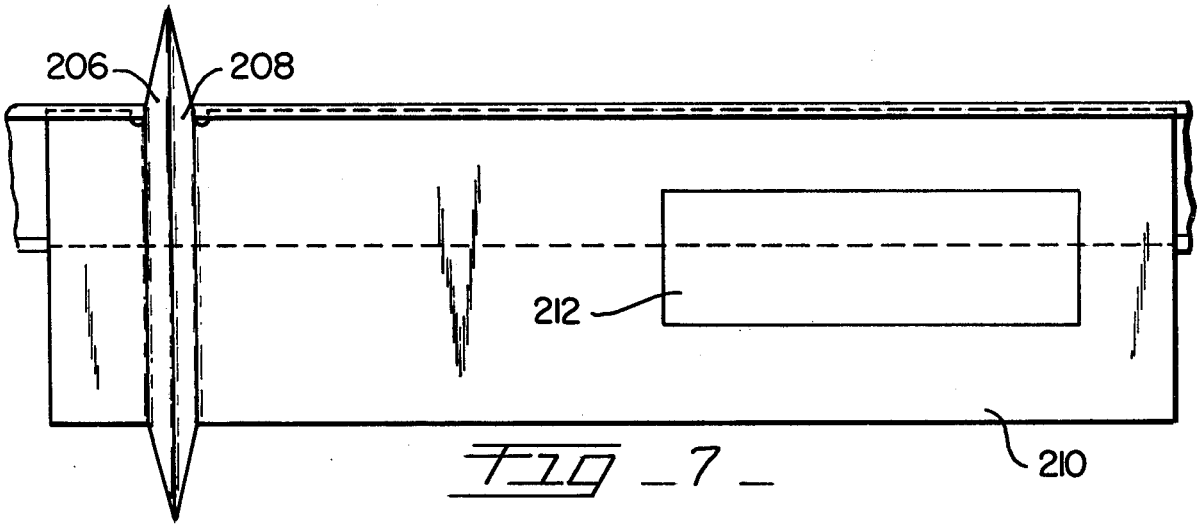
FIG. 7 is a plan view of FIG. 6 wherein the portions have been folded into their final form.
Figure 8:
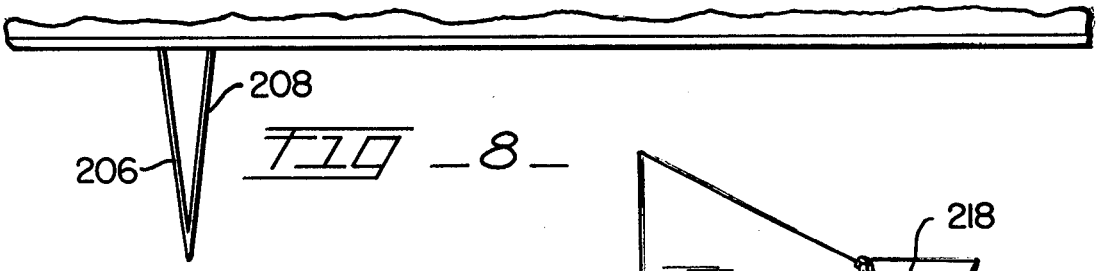
FIG. 8 is a top view of FIG. 7.

Once formed as shown in FIG. 7, the orientation of the folds can be maintained by overlaping locking slits (not shown) in the supporting means 202 or by the friction generated between the elements when cooperating as shown in FIG. 10.

Thus, a flat sheet, of for example paper, having information on only one side can be folded to create a three dimensional display wherein the information is visable from two different directions by virtue of the wing means 206 and 208. The wing means 206 and 208 project out into the free aisle space where they are visable from either direction by shoppers moving through the aisle.

An additional feature of the double fold means 214 is that in the event the display means 200 is contacted by a force from below, such as a product being removed from a lower shelf, it will hinge upwardly around the double fold and thus avoid being torn, or bent etc. The supporting means shown in these embodiments are only illustrative and could be designed to cooperate with any suitable hanger device. Or they could incorporate an adhesive for attachment to a surface.

The present invention thus provides a device constructed of a single flat sheet which has information printed on only one side thereof that can be bent along fold lines to assume a generally three dimensional configuration such that the printed information is orientated generally perpendicular to a viewer's line on travel and horizontal to their field of vision. A second embodiment provides additional information that is orientated parallel to the viewer's line of travel, in that it is visible to the viewer should he stop and turn toward the device. For example, the viewer sees the three dimensional portion at a distance and as they approach to the point directly adjacent to the device if they turn to face the commodity shelf the additional information in the form of tear-off sheets will be directly before them. The supporting means in both embodiments are hinge like in construction to allow movement of the entire device out of or away from a possibly destructive force.

Thus it is apparent that there has been provided, in accordance with the invention, a Device For Displaying Information that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Having thus adequately described the invention, what we claim is:

1. A device constructed of a paper product for displaying information in an orientation which is perpendicular to a viewer's line of travel and horizontal to their field of vision, comprising:

first and second body portions each having a midsection, a free end and means for orientating said body portions defining the other end thereof;

a bridging portion having first and second ends, said bridging portion carrying said first and second body portions and being separated therefrom by first and second fold lines;

holding means flexibly connected to said first end of said bridging portion along another fold line;

a supporting tab designed for insertion in a pricing channel and flexibly connected to said second end of said bridging portion along another fold line thereby providing a flexible hinge permitting vertical displacement of said first and second body portions relative to said support tab; and said first and second fold lines taper outwardly from said holding means and extend substantially to said support tab, said holding means urging the midsections of said body portions together to create a degree of curvature in each body portion thereby lending stability to the device.

2. A three dimensional information displaying device constructed of a single unitary flat resilient sheet with the information being carried on one side thereof comprising:

a support means having a major plane for cooperating with a pricing channel;

a bridging section having a generally flat wedge like shape horizontally projecting away from said pricing channel along a major plane angularly disposed to that of said support means and flexibly connected thereto;

first and second wing-like members flexibly connected to said bridging section along fold lines partly defining the wedge like shape of said bridging section, said first and second wing like members being folded along said fold lines into substantially juxtaposed position such that their major planes are generally perpendicular to that of said bridging section, said first and second wing like members further having front and back portions, said back portion having means for orientating whereby the manner in which it contacts the pricing channel determines the horizontally projecting plane of said bridging section; and a holding means flexibly connected to said bridging section along a fold line, said holding means releasably securing said first and second wing like members in said folded position at a point intermediate the front and back portions such that the wing like members assume generally concurved shapes.

* * * * *